US007448730B2

(12) United States Patent
Hirayama

(10) Patent No.: US 7,448,730 B2
(45) Date of Patent: Nov. 11, 2008

(54) PRINTHEAD, PRINTHEAD SUBSTRATE, INK CARTRIDGE, AND PRINTING APPARATUS HAVING PRINTHEAD

(75) Inventor: Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/577,320

(22) PCT Filed: Nov. 8, 2004

(86) PCT No.: PCT/JP2004/016898

§ 371 (c)(1),
(2), (4) Date: Apr. 28, 2006

(87) PCT Pub. No.: WO2005/044567

PCT Pub. Date: May 19, 2005

(65) Prior Publication Data

US 2007/0076031 A1 Apr. 5, 2007

(30) Foreign Application Priority Data

Nov. 11, 2003 (JP) ..... 2003-381633

(51) Int. Cl.
*B41J 2/05* (2006.01)

(52) U.S. Cl. ..... 347/59; 347/12; 347/5; 347/54

(58) Field of Classification Search ..... 347/9, 347/10, 12, 57, 58, 59
See application file for complete search history.

(56) References Cited

U.S. PATENT DOCUMENTS 5,163,760 A 11/1992 Nardozzi
5,627,732 A 5/1997 Loh et al.
5,671,002 A 9/1997 Murano
5,886,713 A * 3/1999 Okada et al. ..... 347/14
5,933,161 A 8/1999 Sato et al.
5,952,884 A 9/1999 Ide (Continued)

FOREIGN PATENT DOCUMENTS

EP 0 684 537 11/1995

(Continued)

OTHER PUBLICATIONS

English-language translation of Japanese Office Action dated May 15, 2006 issued in Japanese Patent Application No. 2002-348724 (corresponding to U.S. Appl. No. 11/134,416).

(Continued)

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

A printhead includes a plurality of switching elements which are arranged in correspondence with respective printing elements and control energization to the respective printing elements, a reference voltage circuit which generates a reference voltage, a current generation circuit which generates a reference current ($I_{ref}$) on the basis of a reference voltage ($V_{ref}$) generated by the reference voltage circuit, and a plurality of constant current sources which supply, in accordance with the reference current ($I_{ref}$) generated by the current generation circuit, constant currents via the switching elements arranged in correspondence with the respective printing elements.

10 Claims, 12 Drawing Sheets

U.S. PATENT DOCUMENTS

| | | | | |
|---|---|---|---|---|
| 6,371,588 | B1 | 4/2002 | Tsuruoka | |
| 6,400,349 | B1 * | 6/2002 | Nagumo | 345/82 |
| 6,523,922 | B2 | 2/2003 | Hirayama | 347/9 |
| 2003/0038617 | A1 * | 2/2003 | Yaklin | 323/304 |
| 2005/0140707 | A1 | 6/2005 | Imanaka et al. | 347/9 |
| 2005/0206685 | A1 | 9/2005 | Hirayama | |
| 2005/0212857 | A1 | 9/2005 | Hirayama | |
| 2005/0264608 | A1 | 12/2005 | Hirayama | |
| 2005/0264613 | A1 | 12/2005 | Hirayama | |
| 2006/0284909 | A1 | 12/2006 | Kasai et al. | 347/9 |

FOREIGN PATENT DOCUMENTS

| | | |
|---|---|---|
| EP | 1 164 013 | 12/2001 |
| JP | 3-208656 | 9/1991 |
| JP | 5-31938 | 2/1993 |
| JP | 5-270052 | 10/1993 |
| JP | 5-330119 | 12/1993 |
| JP | 8-51322 | 2/1996 |
| JP | 2871779 (B2) | 1/1999 |
| JP | 11-42809 | 2/1999 |
| JP | 11-234060 | 8/1999 |
| JP | 11-291550 (A) | 10/1999 |
| JP | 2000-246900 | * 9/2000 |
| JP | 2001-1513 (A) | 1/2001 |
| JP | 2001-191531 | 7/2001 |
| JP | 2003-58264 | 2/2003 |

OTHER PUBLICATIONS

U.S. Appl. No. 11/449,702, filed Jun. 9, 2006, Ryo Kasai, Tatsuo Furukawa, Masataka Sakurai, Nobuyuki Hirayama.

English-language translation of Korean Office Action issued Sep. 15, 2006 in related Korean patent application No. 2005-7009612.

English-language translation of Japanese Office Action issued Sep. 25, 2006 in related Japanese patent application No. 2002-348724.

English-language translation of Japanese Office Action issued Sep. 25, 2006 in related Japanese patent application No. 2002-348725.

Korean Office Action issued Sep. 15, 2006 in related Korean patent application No. 2005-7009613 and English translation.

Korean Office Action Issued Jun. 18, 2007 In related Korean patent application No. 2005-7009613, and English-language translation.

* cited by examiner

PRINTHEAD, PRINTHEAD SUBSTRATE, INK CARTRIDGE, AND PRINTING APPARATUS HAVING PRINTHEAD

TECHNICAL FIELD

The present invention relates to a printhead having a plurality of printing elements, a printhead substrate, an ink cartridge, and a printing apparatus having the printhead.

BACKGROUND ART

There has been known an inkjet printhead which generates thermal energy by a heater arranged inside its nozzle, forms ink bubbles near the heater by utilizing the thermal energy, and discharges ink from the nozzle by bubbling to print. FIG. 6 shows an example of a heater driving circuit in the inkjet printhead.

In order to print with such a printhead at a high speed, it is desirable to simultaneously drive as many heaters as possible and simultaneously discharge ink from as many nozzles as possible. However, the capacity of an electric power supply (power supply) of a printer is limited, and a current value which can be supplied at once is limited owing to a voltage drop caused by the resistance of a wiring line running from the power supply to the heater. From this, the printhead generally adopts time-division driving of driving a plurality of heaters by time division and discharging ink. In the time-division driving, the printhead comprises a plurality of heaters, the heaters (nozzles) are divided into a plurality of groups, each formed from a plurality of heaters arranged adjacent to each other. The heaters of the groups are driven by time division so that no more than two heaters are simultaneously driven in each group. The sum of currents flowing through heaters is suppressed, and no large electric power need be supplied at once. The operation of the driving circuit which drives heaters in this way will be explained with reference to FIG. 6.

As shown in FIG. 6, heaters $\mathbf{1101}_{a1}$ to $\mathbf{1101}_{mx}$ and MOS transistors $\mathbf{1102}_{a1}$ to $\mathbf{1102}_{mx}$ corresponding to the respective heaters are classified into groups a to m which accommodate the same numbers (x) of heaters and MOS transistors. In group a, a power supply line extending from a positive power supply pad 1104 is commonly connected to the heaters $\mathbf{1101}_{a1}$ to $\mathbf{1101}_{ax}$, and the respective MOS transistors $\mathbf{1102}_{a1}$ to $\mathbf{1102}_{ax}$ are series-connected to the corresponding heaters $\mathbf{1101}_{a1}$ to $\mathbf{1101}_{ax}$ between the power supply line and ground. The heaters $\mathbf{1101}_{a1}$ to $\mathbf{1101}_{ax}$ are heated when a control circuit 1105 supplies a control signal to the gates of the corresponding MOS transistors $\mathbf{1102}_{a1}$ to $\mathbf{1102}_{ax}$ to turn them on and a current flows from the power supply line via heaters series-connected to the transistors.

FIGS. 7A and 7B are timing charts showing timings at which the heaters of each group of the heater driving circuit shown in FIG. 6 are energized and driven. FIG. 7A shows a voltage applied to the base of each transistor, and FIG. 7B shows a current flowing through each heater in correspondence with the applying the base voltage.

Group a in FIG. 6 will be exemplified. Control signals $VG_1$ to $VG_x$ are timing signals for driving the first to x-th heaters $\mathbf{1101}_{a1}$ to $\mathbf{1101}_{ax}$ belonging to the group a. That is, $VG_1$ to $VG_x$ represent the waveforms of signals input to the control terminals (bases) of the MOS transistors $\mathbf{1102}_{a1}$ to $\mathbf{1102}_{ax}$ of the group a. When the control signals $VG_1$ to $VG_x$ are at high level, they turn on corresponding MOS transistors 1102, and when the signals $VG_1$ to $VG_x$ are at low level, turn them off. This also applies to the remaining groups b to m. In FIG. 7B, $Ih_1$ to $Ih_x$ represent current values flowing through the respective heaters $\mathbf{1101}_{a1}$ to $\mathbf{1101}_{ax}$.

In this manner, heaters in each group are sequentially energized and driven by time division. The number of heaters energized and driven in the group can always be controlled to one or less, and no large current need be supplied to heaters at once.

FIG. 8 depicts a view showing an example of the layout of a heater substrate (substrate which forms a printhead) on which the heater driving circuit in FIG. 6 is formed. FIG. 8 illustrates the layout of power supply lines which are connected to groups a to m from the power supply pads 1104 shown in FIG. 6.

Power supply lines $\mathbf{1301}_a$ to $\mathbf{1301}_m$ and $\mathbf{1302}_a$ to $\mathbf{1302}_m$ are individually connected from the power supply pads 1104 to groups a to m. Since the number of heaters simultaneously driven in each group is controlled to one or less, as described above, a current value flowing through the wiring line divided for each group can always be kept equal to or smaller than a current flowing through one heater. Even when a plurality of heaters are simultaneously driven, a voltage drop amount on the line on the heater substrate can be kept constant. At the same time, even when a plurality of heaters are simultaneously driven, an energy amount applied to each heater can be kept almost constant.

In recent years, higher speeds and higher precision are requested of printers, and the printhead of the printer is equipped with many nozzles (heaters) at high density. In driving heater in the printhead, a larger number of heaters must be simultaneously driven at a high speed in terms of the printing speed.

The heater substrate is prepared by forming many heaters and their driving circuit on a single semiconductor substrate. Thus, the heater driving circuit is formed using a low-cost MOS semiconductor process which can fabricate smaller-size devices at higher density by a simpler manufacturing process in comparison with a conventional bipolar semiconductor process. Further, the heater substrate must be downsized because the cost must be reduced by increasing the number of heater substrates formed from one wafer.

As described above, if the number of simultaneously driven heaters is increased, the number of wiring lines corresponding to the number of simultaneously driven heaters must be laid out on the heater substrate. Along with this, the number of wiring lines increases, and when the area of each heater substrate is limited, the wiring resistance increases because the wiring region (width) per wiring line decreases. In addition, each wiring width decreases, and the resistance more greatly varies between wiring lines on the heater substrate. This problem also occurs in downsizing the heater substrate, increasing the wiring resistance and variations in resistance of the wirings. Since a heater and power supply line are series-connected to the power supply on the heater substrate, as described above, a voltage applied to each heater fluctuates at a higher ratio owing to increases in wiring resistance and variations in resistance of the wirings.

Excessively small energy applied to the heater makes ink discharge unstable, but excessively large energy degrades the heater durability. For high-quality printing, energy applied to the heater is desirably constant. However, if a voltage applied to the heater greatly fluctuates, the heater durability degrades or ink discharge becomes unstable.

In a case where a printhead has a plurality of heater substrates, since the wiring line is commonly connected to a plurality of heaters across the heater substrates, a voltage drop on the common wiring line changes at each head substrate, depending on the number of simultaneously driven heaters of each head substrate. In order to keep energy applied to each heater constant over the plurality of heater substrates upon variations in voltage drop, energy applied to the heaters of each heater substrate is adjusted by the voltage application time. However, the voltage drop on the common wiring line becomes larger with an increase in the number of simultaneously driven heaters. The voltage application time prolongs in-driving the heaters in accordance with the number of heater substrates, and it becomes difficult to drive the heaters at a high speed.

Japanese Patent Laid-Open No. 2001-191531 proposes a method which solves problems caused by variations in energy applied to the heaters. FIG. 9 is a circuit diagram showing a heater driving circuit disclosed in Japanese Patent Laid-Open No. 2001-191531. In this reference, heaters (R1 to Rn) are driven by a constant current by constant current sources (Tr14 to Tr(n+13)) and switching elements (Q1 to Qn) which are arranged for the heaters (R1 to Rn) corresponding to printing elements. This configuration can always drive heaters by a constant current regardless of variations in voltage drop outside the heater substrate along with an increase in the number of driven heaters.

In this case, constant current sources equal in number to printing elements are required, the area on the heater substrate greatly increases, and thus the cost of the heater substrate rises. In order to stabilize energy applied to the heater, output currents must be equal between a plurality of constant current sources. However, as the number of constant current sources increases, the output currents more greatly vary between the constant current sources. Especially when the number of heaters increases for a higher-speed, higher-precision printer, the number of constant current source circuits increases, and it becomes difficult to reduce variations in output current.

DISCLOSURE OF INVENTION

The present invention has been made in consideration of the above situation, and has as its features to provide a printhead capable of making a current flowing through each printing element almost constant and stably printing at a high speed, a printhead substrate, an ink cartridge, and a printing apparatus having the printhead.

According to an aspect of the invention, there is provided with a printhead having a plurality of printing elements, comprises: a plurality of switching elements being arranged in correspondence with the respective printing elements and configured to control energization to the respective printing elements; a reference voltage circuit configured to generate a reference voltage; a current generation circuit configured to generate a reference current on the basis of the reference voltage generated by the reference voltage circuit; and a plurality of constant current sources configured to supply, in accordance with the reference current generated by the current generation circuit, constant currents via the switching elements arranged in correspondence with the respective printing elements.

According to other aspect of the invention, there is provided with a printhead characterized by comprises: a plurality of element driving blocks each having a plurality of printing elements, a plurality of switching elements configured to be arranged in correspondence with the respective printing elements and control energization to the respective printing elements, and a plurality of constant current sources configured to supply constant currents via the switching elements arranged in correspondence with the respective printing elements; a reference voltage circuit configured to generate a reference voltage; and a current generation circuit configured to generate a plurality of reference currents on the basis of the reference voltage generated by the reference voltage circuit, wherein each of the constant current sources being arranged in each of the plurality of element driving blocks supplies a constant current corresponding to any one of the plurality of reference currents via the switching element being arranged in correspondence with the each printing element of the element driving block.

Other features, objects and advantages of the present invention will be apparent from the following description when taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

BEST MODE FOR CARRYING OUT THE INVENTION

Preferred embodiments of the present invention will be described in detail below with reference to the accompanying drawings. A "heater substrate" to be described later means not only a base substrate formed from a silicon semiconductor, but also a base substrate having elements, wiring lines, and the like. "On a heater substrate" means not only "on the surface of a heater substrate", but also "inside an element base near the surface". "Built-in" according to the embodiments does not mean to simply arrange separated elements on a base substrate but to integrally form and manufacture elements on a heater substrate by a semiconductor circuit manufacturing process or the like.

First Embodiment

Figure 1:
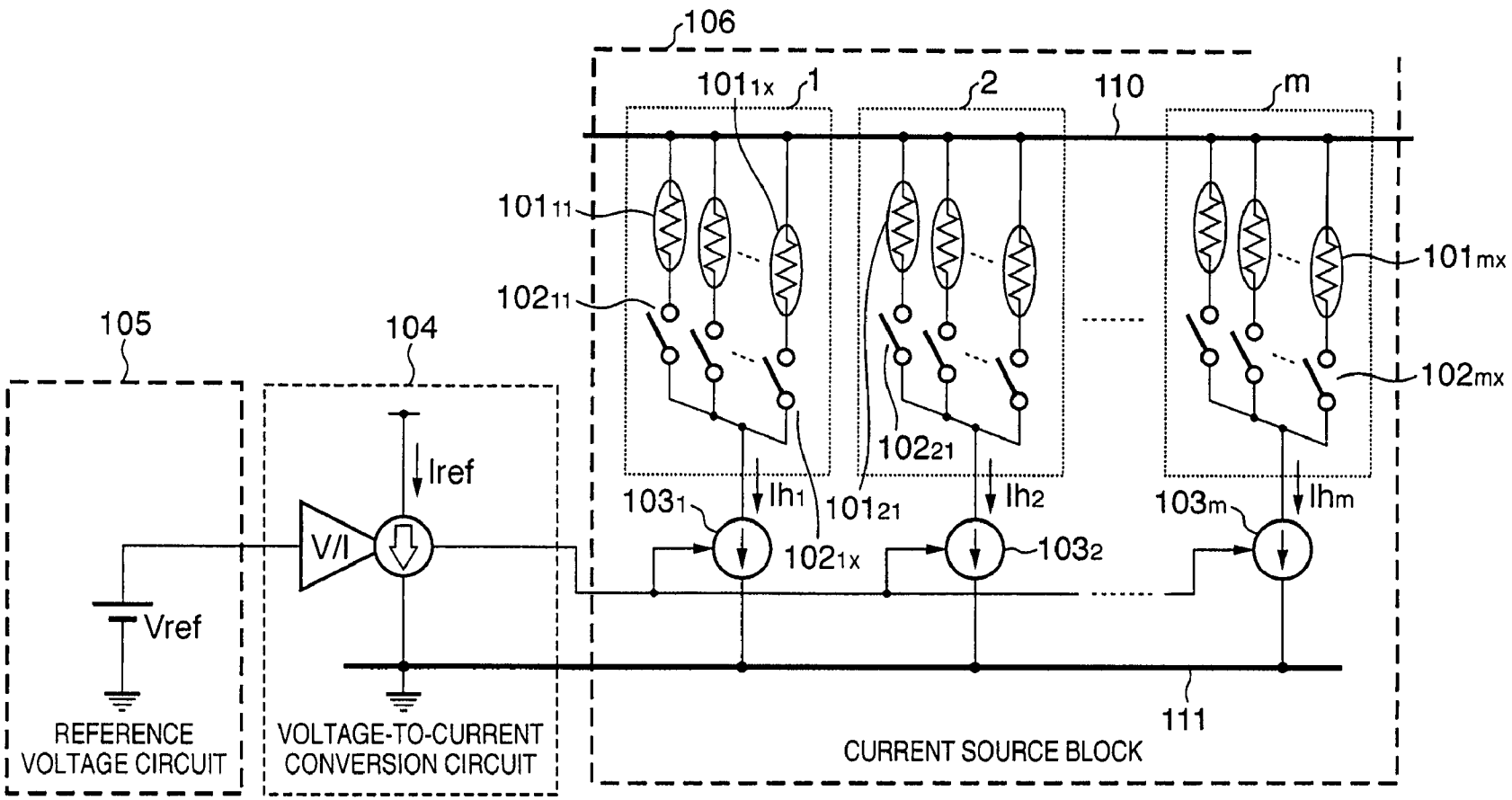
FIG. 1 is a block diagram showing the schematic configuration of a heater driving circuit arranged on a printhead according to the first embodiment of the present invention.

FIG. 1 is a block diagram showing the configuration of a heater driving circuit arranged on the heater substrate of an inkjet printhead according to the first embodiment of the present invention. The heater driving circuit roughly comprises a reference voltage circuit 105, voltage-to-current conversion circuit 104, and current source block 106.

Figure 2:
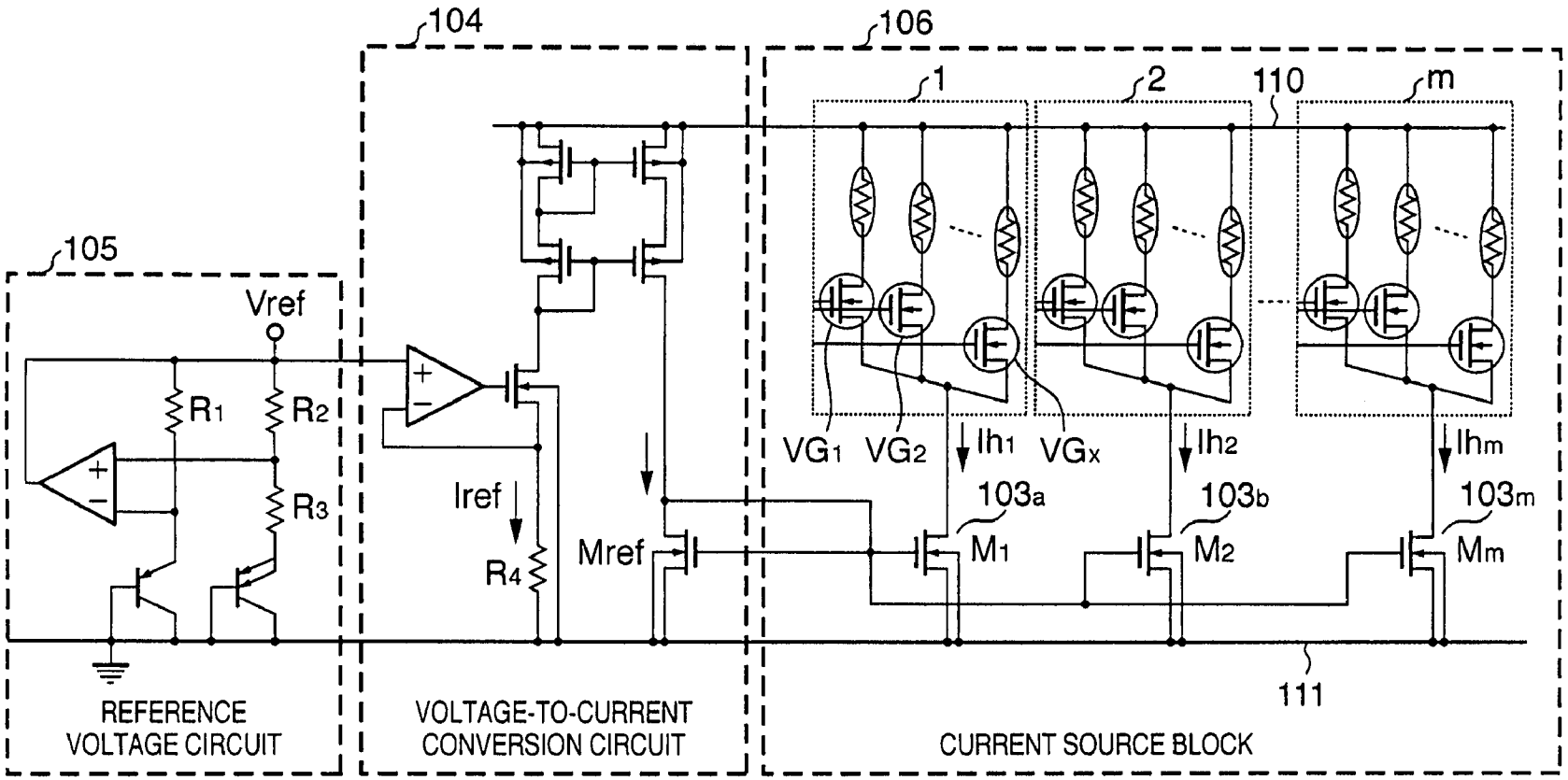
FIG. 2 is a circuit diagram for explaining an example of the heater driving circuit according to the first embodiment of the present invention.

FIG. 2 is a circuit diagram showing an example of the driving circuit shown in FIG. 1.

The first embodiment will explain a printhead which is formed from m heater groups each accommodating x heaters 101 and has a total of (x×m) heaters 101.

In FIG. 1, the reference voltage circuit 105 generates a reference voltage $V_{ref}$ serving as the reference of the voltage-to-current conversion circuit 104. The reference voltage circuit 105 desirably outputs a stable voltage upon changes in power supply voltage and temperature. For example, as shown in FIG. 2, a stable voltage can be obtained upon changes in power supply and temperature by using a band gap voltage. The example of FIG. 2 depicts a reference voltage circuit using a PNP transistor which is uniquely parasitic on a CMOS semiconductor process. The voltage difference between two diode-connected PNP transistors has a positive temperature coefficient, and the voltage between the terminals of the diode-connected PNP transistors has a negative temperature coefficient. These two voltages are so added as to cancel the temperature coefficients, generating a voltage which does not change regardless of the temperature. This voltage is unique to the semiconductor, has a merit of being hardly influenced by variations in manufacture, and thus is an optimal reference voltage.

The voltage-to-current conversion circuit 104 converts a voltage into a current on the basis of the reference voltage $V_{ref}$ from the reference voltage circuit 105, and generates a reference current $I_{ref}$ from the reference voltage $V_{ref}$. In the example of FIG. 2, as an example of voltage-to-current conversion, the reference voltage $V_{ref}$ is applied to a resistor $R_4$ via an operational amplifier, and a current flowing through the resistor $R_4$ is generated as the reference current $I_{ref}$. Letting $R_{ref}$ be the resistance value of the resistor $R_4$, the reference current $I_{ref}$ is given by $$I_{ref}=V_{ref}/R_{ref}$$

The reference current $I_{ref}$ and constant current sources $\mathbf{103}_1$ to $\mathbf{103}_m$ form current mirror circuits. The current sources $\mathbf{103}_1$ to $\mathbf{103}_m$ respectively output constant currents $Ih_1$ to $I_m$ proportional to the reference current $I_{ref}$ on the basis of the reference current $I_{ref}$. In the example of FIG. 2, a MOS transistor $M_{ref}$ and MOS transistors $M_1$ to $M_m$ form current mirror circuits having a common gate. In this case, only one of the MOS transistors $M_1$ to $M_m$ is turned on at a predetermined timing, and a constant current ($Ih_1$ to $Ih_m$) corresponding to the reference current $I_{ref}$ is output from the drain terminal of the ON transistor.

The current source block 106 comprises the (x×m) heaters 101 ($\mathbf{101}_{11}$ to $\mathbf{101}_{mx}$) (heating elements) constituted of (x×m) resisters and the like, switching elements 102 ($\mathbf{102}_{11}$ to $\mathbf{102}_{mx}$) equal in number to the heaters 101, and the constant current sources $\mathbf{103}_1$ to $\mathbf{103}_m$ for groups 1 to m. Each switching element 102 is controlled to supply or stop a current between terminals by a control signal from the control circuit of a printer main body (to be described later) in accordance with an image signal to be printed. The (x×m) heaters 101 and the switching elements 102 which are arranged in correspondence with the respective heaters are divided into groups 1 to m each storing x heaters 101 and x switching elements 102. Each of the heater resistors $\mathbf{101}_{11}$ to $\mathbf{101}_{mx}$ and each of the driving control switching elements $\mathbf{102}_{11}$ to $\mathbf{102}_{mx}$ corresponding to the respective heater resistors $\mathbf{101}_{11}$ to $\mathbf{101}_{mx}$ are series-connected to each other. Within the respective groups, the ground terminals of the constant current sources $\mathbf{103}_1$ to $\mathbf{103}_m$ are commonly connected, whereas their terminals on a power supply line (wiring on a high voltage side) 110 side are also commonly connected. The output terminals of the constant current sources $\mathbf{103}_1$ to $\mathbf{103}_m$ arranged for groups 1 to m are respectively connected to the commonly connected terminals of the groups in which the heaters 101 and switching elements 102 are series-connected. The constant current sources 103 are connected to a ground line (wiring on a low voltage side) 111. Energization to the heaters is controlled by switching the switching elements 102 within the respective groups by a control signal $VG_n$ (n=1 to x) and supplying the output currents $Ih_1$ to $Ih_m$ of the constant current sources $\mathbf{103}_1$ to $\mathbf{103}_m$ arranged for the respective groups to desired heaters. In FIG. 2, the switching element 102 is a MOS transistor, its gate terminal is connected to the above-described control circuit, and switching between the drain and source of the MOS transistor is controlled by the control signal VG.

In the embodiment, the heater 101 and the switching element 102 are connected to the power supply line (high voltage) 110 in series and the constant current source 103 is connected to the ground line (low voltage side) 111 so that the following merits arise. A power supply voltage is not applied to a drain of a MOS transistor of the constant current source 103 when the switching element 102 is OFF (open), and even when the switching element 102 is ON (closed), a high voltage is not applied to the drain of the MOS transistor because of the voltage drop due to the current flowing through the heater 101. As the result, the endurance of voltage of the MOS transistor in the constant current source 103 can be lower than that of a MOS transistor in the switching element 102. The constant current source 103 can be constructed using MOS transistors having a low endurance of voltage, each of which has a simple structure because that particular manufacturing process of the transistor having an improved endurance of voltage is not necessary, such that a variance of characteristics of the MOS transistors between the constant current sources can be reduced and a variance of output currents from the constant current source can be reduced.

Further, the constant current source and the switching elements are respectively constructed by different transistors from each other so that an influence to the constant current caused by the switching element is suppressed. Furthermore, the constant current source and the switching elements are separately constructed not integrated so that the endurance of voltage of the transistors in the constant current source can be lower as described above, and an influence due to the variance between the constant current sources can be suppressed.

[Operation of Heater Driving Circuit]

The operation of the heater driving circuit will be explained with reference to the timing charts of FIGS. 3A and 3B by giving attention to x heaters $\mathbf{101}_{11}$ to $\mathbf{101}_{1x}$ stored in group 1 in the heater driving circuit shown in FIG. 1.

Figure 3A:
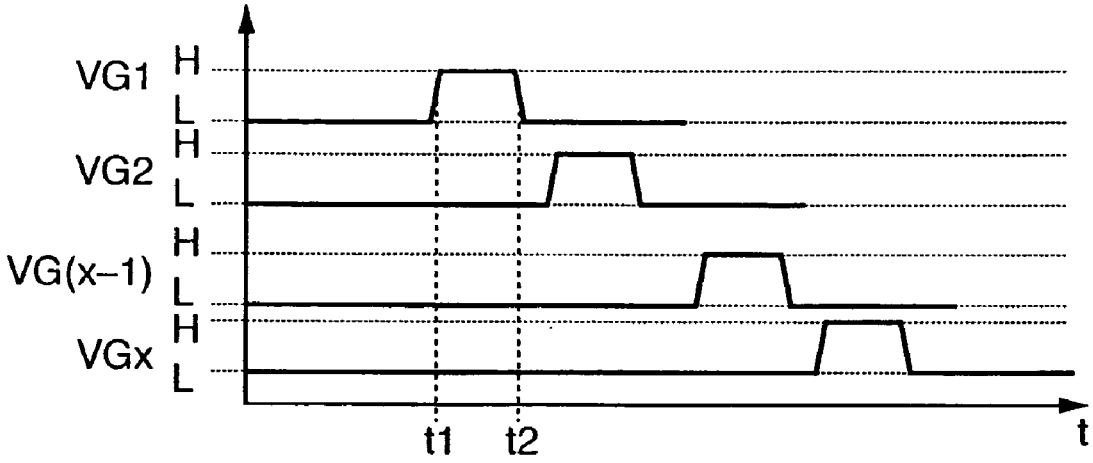
FIGS. 3A and 3B are timing charts for explaining the operation timing of the circuit in FIG. 2.
Figure 3B:
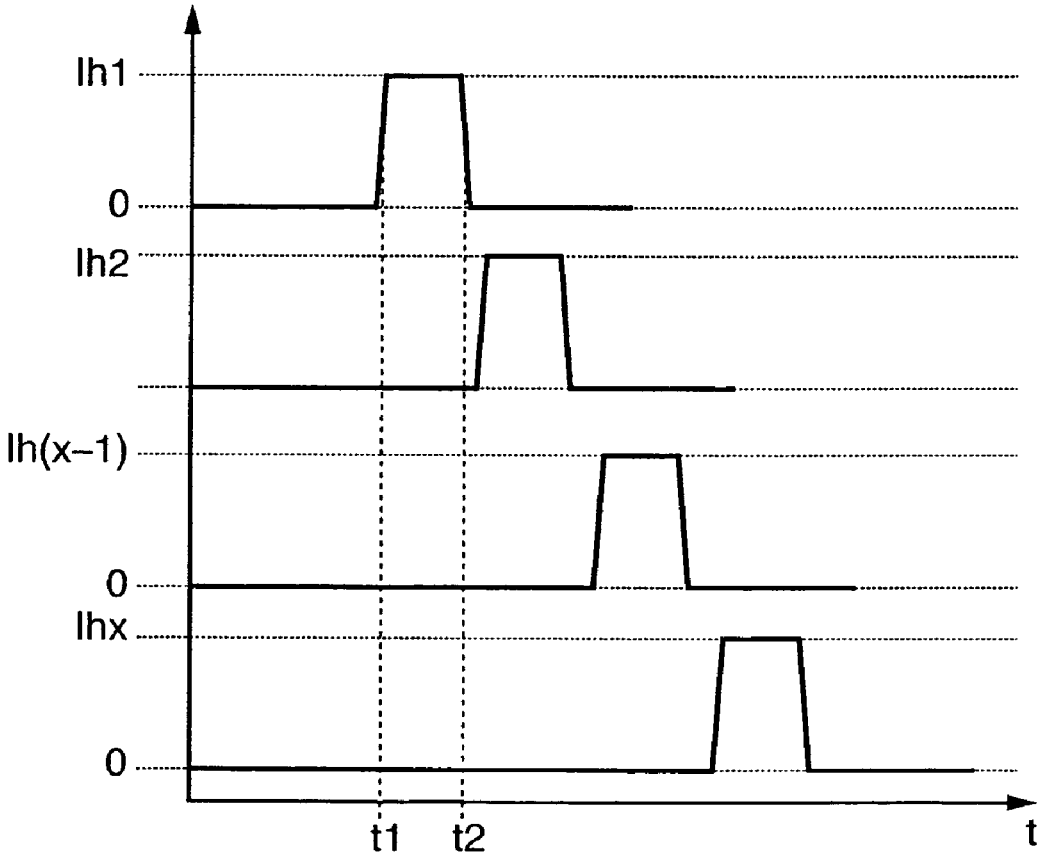

FIG. 3A is a timing chart showing an example of the waveform of a gate control signal $VG_n$ supplied to the gate of each switching element 102. FIG. 3B is a timing chart for explaining a current amount flowing through each heater 101.

The waveforms of the control signals $VG_1$ to $VG_x$ in FIG. 3A represent gate control signals which control to turn on (enable) or off (disable) the switching elements $\mathbf{102}_{11}$ to $\mathbf{102}_{1x}$ in FIG. 1. When the signal level of the signal $VG_n$ is "high level", a corresponding switching element 102 is turned on (enabled), and when it is "low level", the element 102 is turned off (disabled).

In the example of FIG. 3A, all the heaters $\mathbf{101}_{11}$ to $\mathbf{110}_{1x}$ in group 1 are sequentially driven. Note that FIGS. 1 and 2 do not illustrate the control signal $VG_1$ to $VG_x$ for the switching elements $\mathbf{102}_{11}$ to $\mathbf{102}_{1x}$.

In FIG. 3A, during the period up to time t1, all the control signals $VG_1$ to $VG_x$ are at "low level", the output of the constant current source $\mathbf{103}_1$ and the heaters $\mathbf{101}_{11}$ to $\mathbf{101}_{1x}$ are disconnected, and thus no current flows through the heaters $\mathbf{101}_{11}$ to $\mathbf{101}_{1x}$. During the period between time t1 and time t2, only the control signal $VG_1$ changes to "high level". Only the switching element 1021, is short-circuited, and the output current $Ih_1$ of the constant current source $\mathbf{103}_1$ flows through the heater $\mathbf{101}_{11}$. This is represented by $Ih_1$ in FIG. 3B. From time t2, the control signal $VG_1$ changes to "low level" to stop energization to the heater $\mathbf{101}_{11}$.

In this manner, during the period between time t1 and time t2, a current is supplied to only the heater $\mathbf{101}_{11}$ to execute heating by the heater $\mathbf{101}_{11}$. Ink near the heater $\mathbf{101}_{11}$ is heated and bubbles. Ink is discharged from a nozzle having the heater $\mathbf{101}_{11}$, and a predetermined pixel (dot) is printed.

Subsequently when the gate control signal $VG_2$ changes to "high level", the switching element $\mathbf{102}_{12}$ is short-circuited to supply the output current $Ih_2$ of the constant current source $\mathbf{103}_1$ to the heater $\mathbf{101}_{12}$. This is illustrated by $Ih_2$ in FIG. 3B.

Similarly, the gate control signals $VG_n$ sequentially change to "high level" to sequentially turn on the switching elements $\mathbf{102}_{11}$ to $\mathbf{102}_{1x}$. The output current $Ih_1$ of the constant current source $\mathbf{103}_1$ is sequentially supplied to the heaters $\mathbf{101}_{11}$ to $\mathbf{101}_{1x}$ to drive all the heaters $\mathbf{101}_{11}$ to $\mathbf{101}_{1x}$ included in the group 1. The case in which all the heaters $\mathbf{101}_{11}$ to $\mathbf{101}_{1x}$ in the group 1 are sequentially driven has been described. In practice, only a heater for forming a desired dot is driven, and only when a desired dot is to be printed by the control signal $VG_n$, a signal $VG_n$, corresponding to the switching element changes to "high level".

The above operation is similarly executed for heaters included in the groups 2 to m to control energization to the heaters. As a result, arbitrary ones of the (x×m) heaters can be driven.

Second Embodiment

Figure 4:
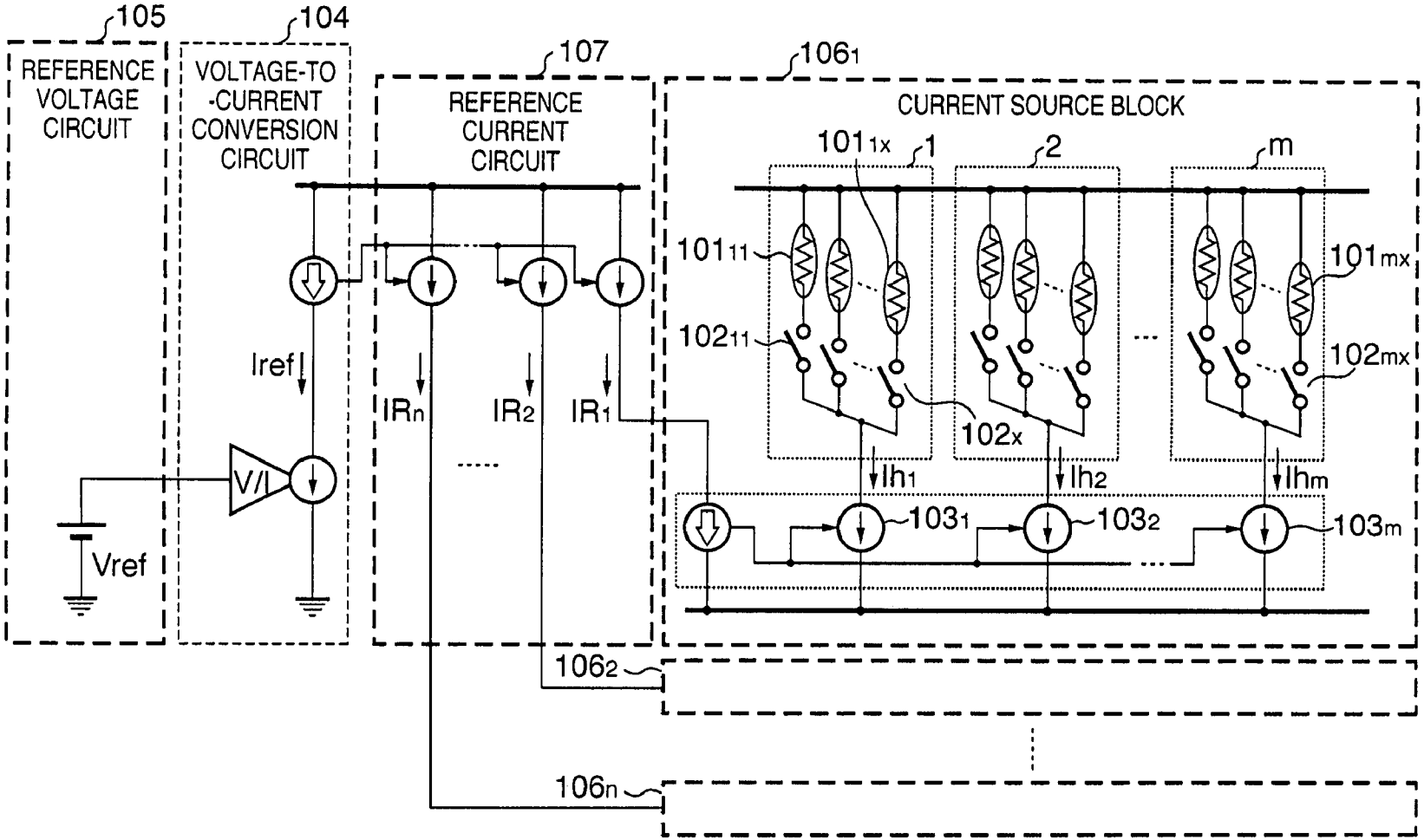
FIG. 4 is a block diagram showing the schematic configuration of a heater driving circuit arranged on a printhead according to the second embodiment of the present invention.

FIG. 4 is a block diagram showing the configuration of a heater driving circuit arranged on the heater substrate of an inkjet printhead according to the second embodiment of the present invention. The heater driving circuit roughly comprises a reference voltage circuit 105, voltage-to-current conversion circuit 104, and current source blocks 106.

Figure 5:
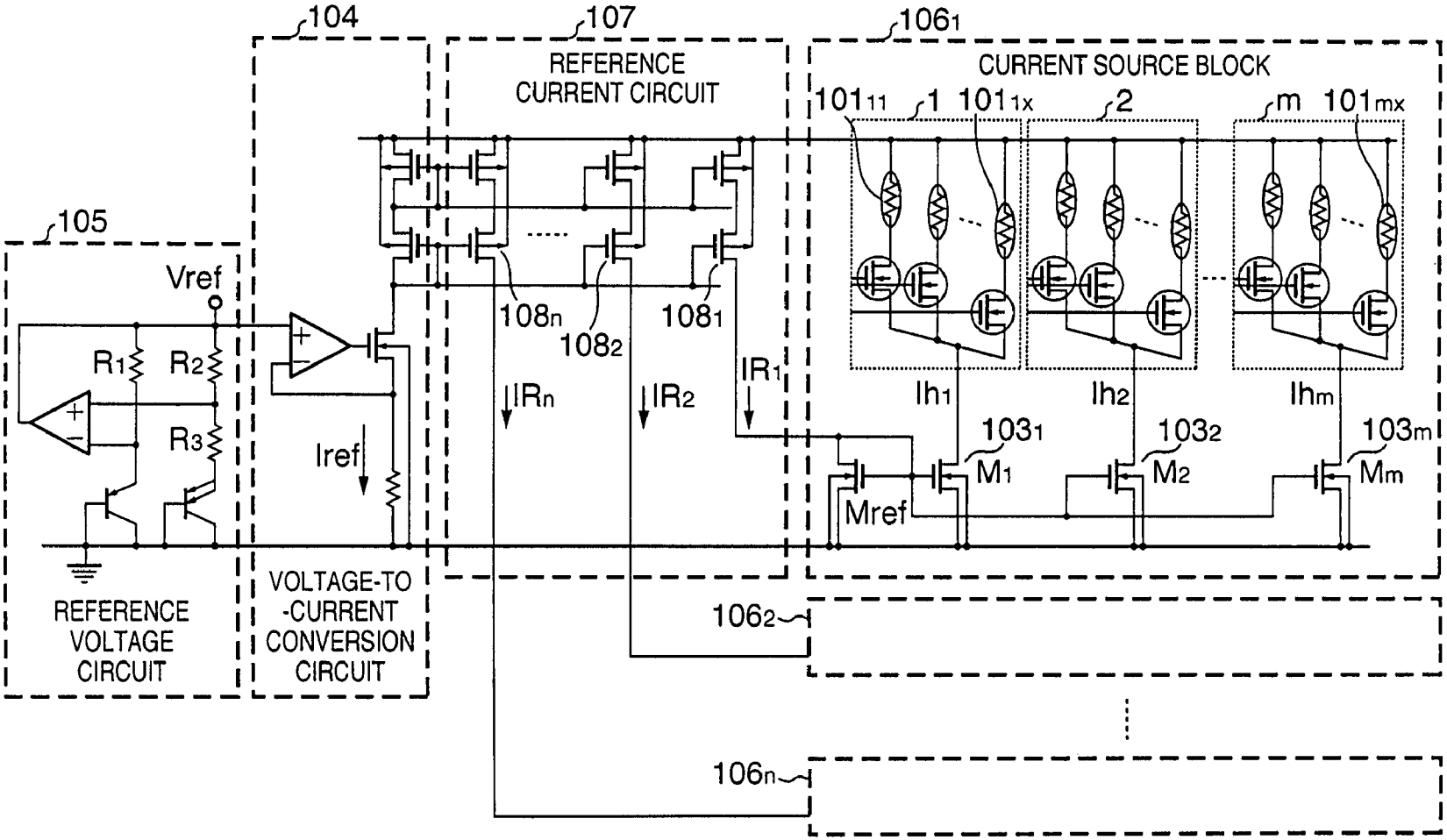
FIG. 5 is a circuit diagram for explaining an example of the heater driving circuit according to the second embodiment of the present invention.
Figure 6:
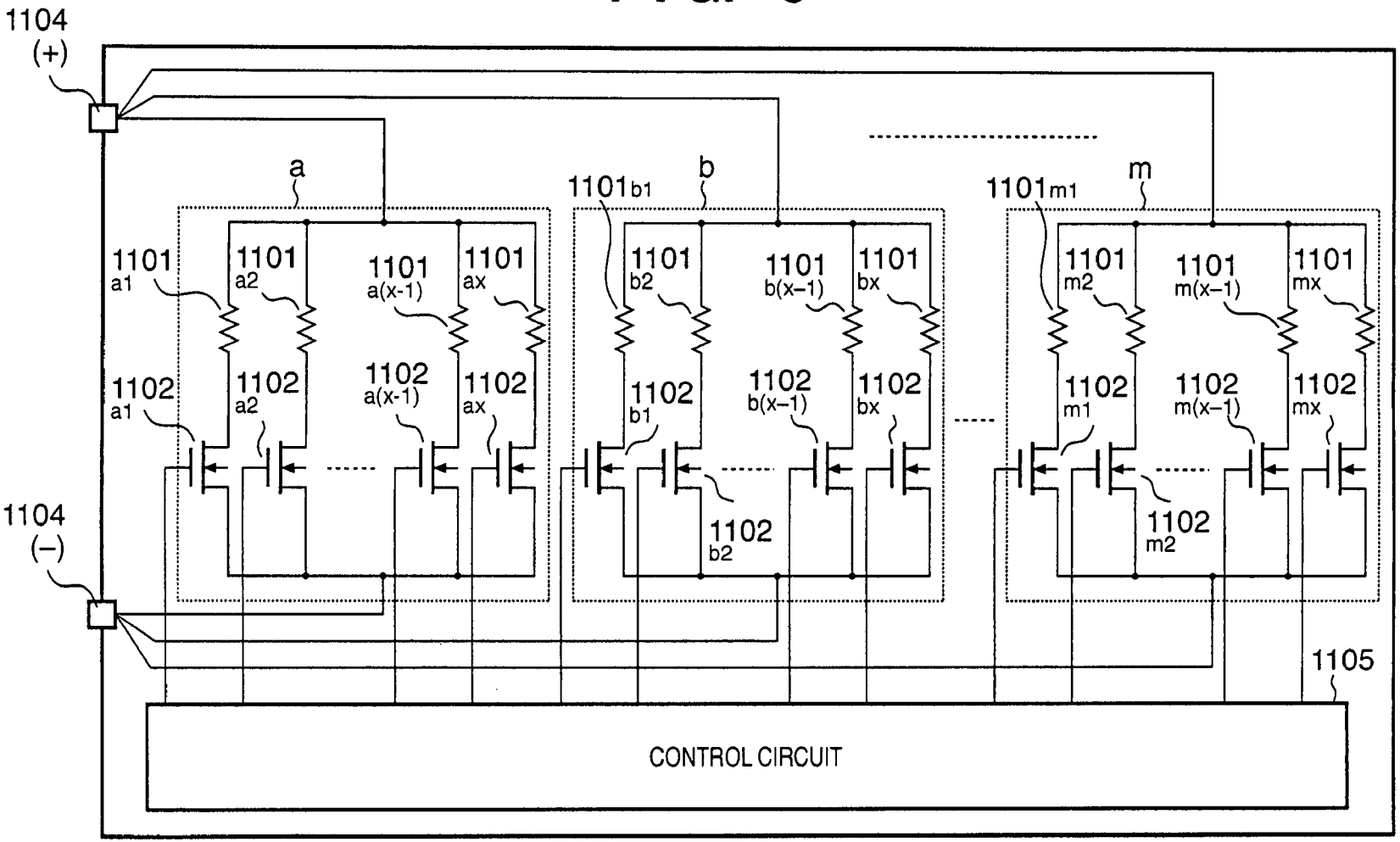
FIG. 6 is a circuit diagram showing a conventional heater driving circuit.
Figure 7A:
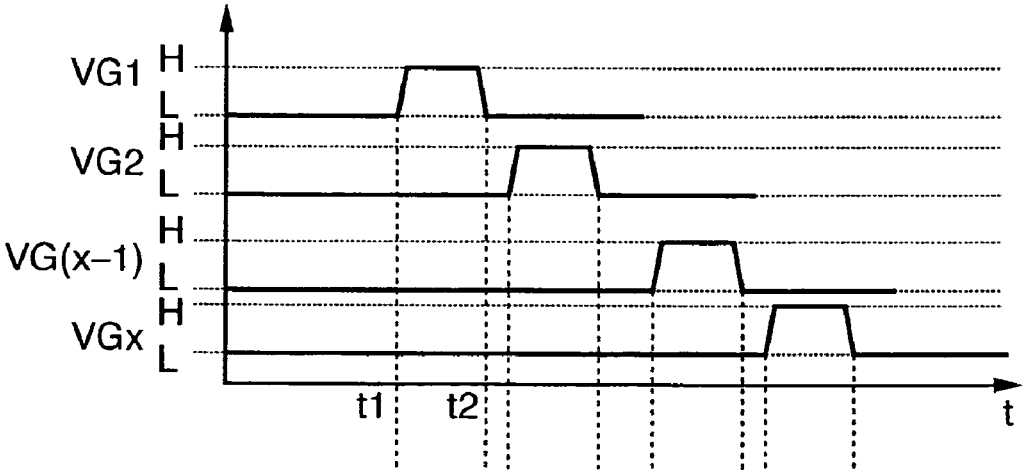
FIGS. 7A and 7B are timing charts showing signals which operate the conventional driving circuit.
Figure 7B:
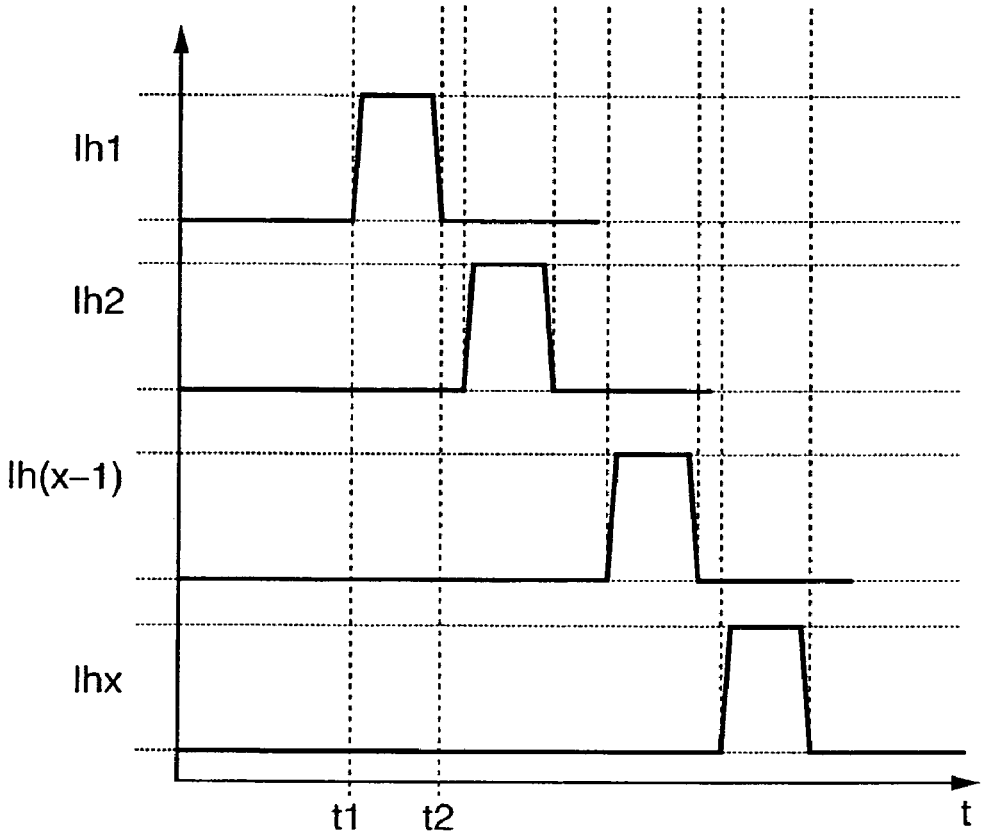
Figure 8:
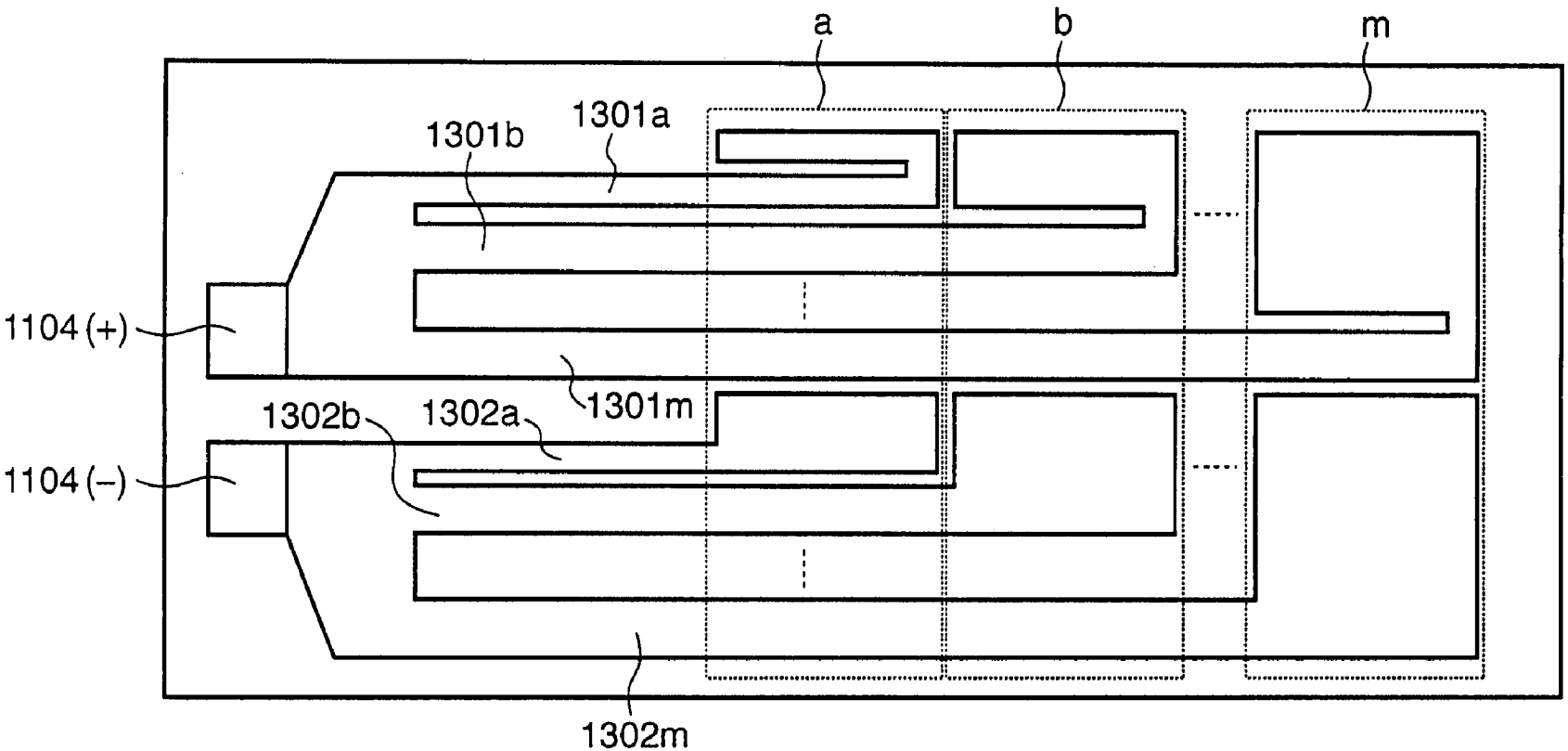
FIG. 8 depicts a view showing the wiring layout of a conventional heater substrate.
Figure 9:
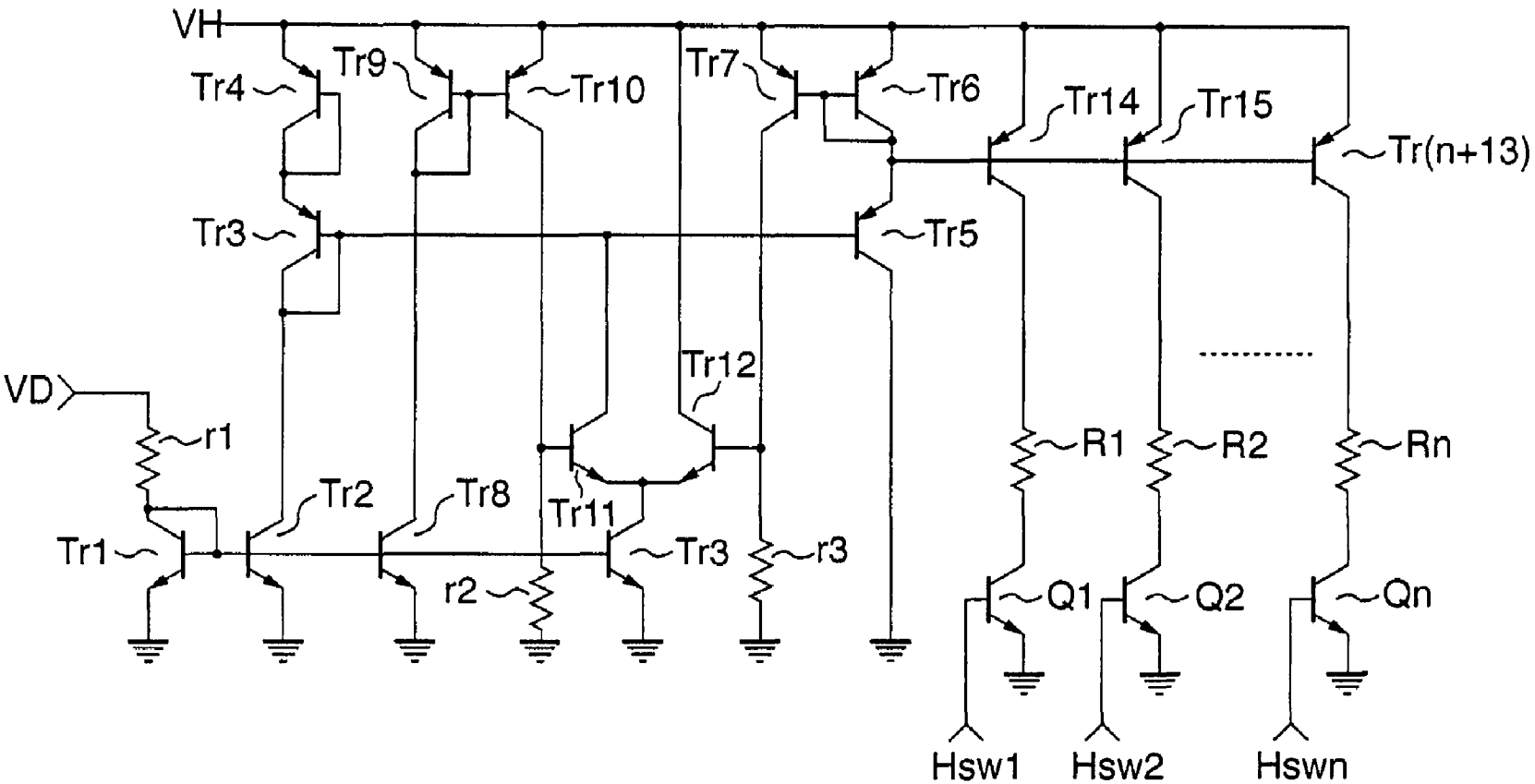
FIG. 9 is a circuit diagram showing the configuration of the conventional heater driving circuit.

FIG. 5 is a circuit diagram showing an example of the circuit in FIG. 4.

The configuration in FIG. 4 is different from that in the first embodiment in that a reference current circuit 107 is interposed between the voltage-to-current conversion circuit 104 and the current source blocks 106 and a plurality of current source blocks 106 are arranged.

The operations of the reference voltage circuit 105 and voltage-to-current conversion circuit 104 are the same as those in the first embodiment described above. The reference current circuit 107 generates a plurality of reference currents $IR_1$ to $IR_n$ on the basis of a reference current $I_{ref}$ generated by the voltage-to-current conversion circuit 104. In practice, as shown in FIG. 5, current mirror circuits generate currents $IR_1$ to $IR_n$ proportional to the reference current $I_{ref}$, and the currents $IR_1$ to $IR_n$ are respectively supplied to n current source blocks $\mathbf{106}_1$ to $\mathbf{106}_n$.

In the current source blocks $\mathbf{106}_1$ to $\mathbf{106}_n$, constant currents $Ih_1$ to $Ih_m$ proportional to the reference currents $IR_1$ to $IR_n$ are output from constant current sources $\mathbf{103}_1$ to $\mathbf{103}_m$ in each of the n current source blocks $\mathbf{106}_1$ to $\mathbf{106}_n$ on the basis of the reference currents $IR_1$ to $IR_n$.

Each of the constant current source blocks 106 has the same configuration as that of the current source block 106 according to the first embodiment. The constant current block 106 comprises (x×m) heaters 101, switching elements 102 equal in number to the heaters 101, and the constant current sources $\mathbf{103}_1$ to $\mathbf{103}_m$ for m groups. Each switching element 102 is controlled to supply or stop a current between terminals by a control signal from the control circuit of a printer main body. The (x×m) heaters 101 and the switching elements 102 are divided into m groups each including x heaters 101 and x switching elements 102. Each heater resistor 101 and each switching element 102 for controlling driving of each heater resistor are series-connected to each other. Power supply terminals and ground terminals are commonly connected within each group.

The output terminals of the constant current sources ($\mathbf{103}_1$ to $\mathbf{103}_m$) arranged in groups 1 to m of each constant current source block 106 are respectively connected to the common connection terminals of groups 1 to m in which the heaters 101 and switching elements 102 are series-connected. By turning on/off the switching elements 102 in each group by the control signal, the output currents $Ih_1$ to $Ih_m$ of the constant current sources $\mathbf{103}_1$ to $\mathbf{103}_m$ arranged in the respective groups are supplied to desired heaters.

A plurality of (n) current source blocks 106 ($\mathbf{106}_1$-$\mathbf{106}_n$) having the same configuration are arranged, and heater driving operation in each current source block 106 is the same as that in the first embodiment. The same operation is performed for the n current source blocks $\mathbf{106}_1$ to $\mathbf{106}_n$, and arbitrary ones of the (x×m×n) heaters can be driven to generate heat.

In order to obtain a high-quality printed image and improve the heater durability, electric powers applied to heaters must be equal between a plurality of heaters, i.e., if the resistance values of the heaters are equal to each other, output currents must be equal between a plurality of current source blocks.

In the second embodiment, the output currents of the current sources $\mathbf{103}_1$ to $\mathbf{103}_m$ in the current source block 106 must be equal in each of the current source blocks $\mathbf{106}_1$ to $\mathbf{106}_n$.

The constant current outputs $Ih_1$ to $Ih_m$ in each current source block 106 are determined on the basis of the reference current $IR_n$. For this reason, the relative precision of the output currents $Ih_1$ to $Ih_m$ within the current source block 106 is increased by arranging the reference current $IR_n$ and the current sources $\mathbf{103}_1$ to $\mathbf{103}_m$ adjacent to each other.

In order to make constant current outputs equal between the current source blocks 106, the reference currents $IR_1$ to $IR_n$ in the current source blocks 106 must be equal between the current source blocks 106. Hence, the relative precision of the reference currents $IR_1$ to $IR_n$ can be increased by arranging the reference current source 107 for generating the reference currents $IR_1$ to $IR_n$, adjacent to the current source blocks 106.

The relative precision of the output currents of constant current sources between the current source blocks 106 can be increased by arranging the constant current sources $\mathbf{103}_1$ to $\mathbf{103}_m$ in each current source block 106 adjacent to each other and arranging reference current sources 108 ($\mathbf{108}_1$ to $\mathbf{108}_n$) in the reference current circuit 107 adjacent to each other. The relative positional relationship between the reference current circuit 107 and the current source blocks 106 does not seriously influence the relative precision of output currents between the constant current sources. The degree of freedom for the layout of the current source blocks 106 increases, and the current source blocks 106 can be arranged efficiently in terms of the area.

In the above-described embodiments, the constant current source may be a MOS transistor which operates in the saturation region wherein the drain current hardly changes with respect to the drain voltage.

The circuit configuration in the above-described embodiments can be integrally built in the above-described heater substrate. Heating elements can be controlled and driven by a constant current within the heater substrate having heating elements for discharging ink.

Further, in the above describe embodiments, an example in which a constant current source is provided in each group is explained, but the constant current source may be provided to each heater. According to the above described embodiments, the number of the constant current source can be reduced so that the heater driving circuit is downsized and an effect due to the variation of characteristics of the constant current sources can be suppressed.

Further, in the embodiment, each group has the constant current source so that the number of the constant current sources can be reduced and the size of the circuit on the heater board can be reduced. The influence due to the variance of the constant current sources can be suppressed.

An inkjet head having a heater substrate with the above-described configuration and an inkjet printing apparatus which mounts the inkjet head will be exemplified.

Figure 10:
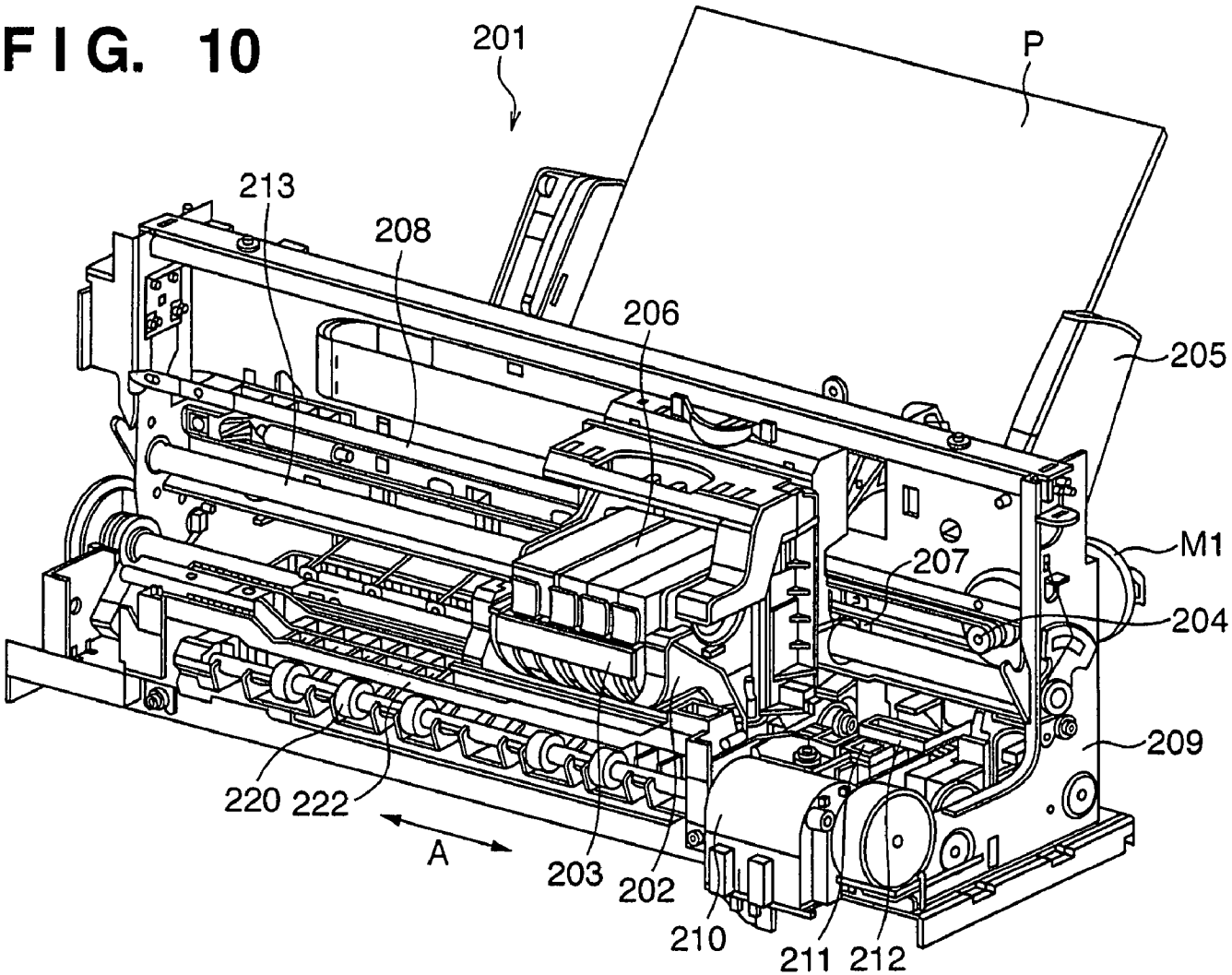
FIG. 10 depicts an outer perspective view showing the schematic configuration of an inkjet printing apparatus according to an embodiment.

FIG. 10 depicts an outer perspective view showing the schematic configuration of an inkjet printing apparatus 201 as a typical embodiment of the present invention.

As shown in FIG. 10, in the inkjet printing apparatus (to be referred to as a printing apparatus hereinafter), a transmission mechanism 204 transmits a driving force generated by a carriage motor M1 to a carriage 202 which supports a printhead 203 for discharging ink to print by the inkjet method. The carriage 202 reciprocates in a direction indicated by an arrow A. A printing medium P such as a printing sheet is fed via a sheet feed mechanism 205, and conveyed to a printing position. At the printing position, the printhead 203 discharges ink to the printing medium P to print. In order to maintain a good state of the printhead 203, the carriage 202 is moved to the position of a recovery device 210, and a discharge recovery process for the printhead 203 is executed intermittently.

The carriage 202 of the printing apparatus 201 supports not only the printhead 203, but also an ink cartridge 206 which stores ink to be supplied to the printhead 203. The ink cartridge 206 is detachably mounted on the carriage 202.

The printing apparatus 201 shown in FIG. 10 can print in color. For this purpose, the carriage 202 supports four ink cartridges which respectively store magenta (M), cyan (C), yellow (Y), and black.(K) inks. The four ink cartridges are independently detachable.

The carriage 202 and printhead 203 can achieve and maintain a predetermined electrical connection by properly bringing their contact surfaces into contact with each other. The printhead 203 selectively discharges ink from a plurality of orifices and prints by applying energy in accordance with the printing signal. In particular, the printhead 203 according to the embodiment adopts an inkjet method of discharging ink by using thermal energy, and comprises an electrothermal transducer in order to generate thermal energy. Electric energy applied to the electrothermal transducer is converted into thermal energy. Ink is discharged from orifices by utilizing a pressure change caused by the growth and contraction of bubbles by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 10, the carriage 202 is coupled to part of a driving belt 207 of the transmission mechanism 204 which transmits the driving force of the carriage motor M1. The carriage 202 is slidably guided and supported along a guide shaft 13 in the direction indicated by the arrow A. The carriage 202 reciprocates along the guide shaft 13 by normal rotation and reverse rotation of the carriage motor Ml. A scale 208 which represents the absolute position of the carriage 202 is arranged along the moving direction (direction indicated by the arrow A) of the carriage 202. In the embodiment, the scale 208 is prepared by printing black bars on a transparent PET film at a necessary pitch. One end of the scale 208 is fixed to a chassis 209, and its other end is supported by a leaf spring (not shown).

The printing apparatus 201 has a platen (not shown) in opposition to the orifice surface having the orifices (not shown) of the printhead 203. Simultaneously when the carriage 202 supporting the printhead 203 reciprocates by the driving force of the carriage motor M1, a printing signal is supplied to the printhead 203 to discharge ink and print on the entire width of the printing medium P conveyed onto the platen.

Reference numeral 220 denotes a discharge roller which discharges the printing medium P bearing an image formed by the printhead 203 outside the printing apparatus. The discharge roller 220 is driven by transmitting rotation of the conveyance motor M2. The discharge roller 220 abuts against a spur roller (not shown) which presses the printing medium P by a spring (not shown). Reference numeral 222 denotes a spur holder which rotatably supports the spur roller.

As shown in FIG. 10, in the printing apparatus 201, the recovery device 210 which recovers the printhead 203 from a discharge failure is arranged at a desired position (e.g., a position corresponding to the home position) outside the reciprocation range (printing area) for printing operation of the carriage 202 supporting the printhead 203.

The recovery device 210 comprises a capping mechanism 211 which caps the orifice surface of the printhead 203, and a wiping mechanism 212 which cleans the orifice surface of the printhead 203. The recovery device 210 performs a discharge recovery process in which a suction means (suction pump or the like) within the recovery device forcibly discharges ink from orifices in synchronism with capping of the orifice surface by the capping mechanism 211, thereby removing ink with a high viscosity or bubbles in the ink channel of the printhead 203.

In non-printing operation or the like, the orifice surface of the printhead 203 is capped by the capping mechanism 211 to protect the printhead 203 and prevent evaporation and drying of ink. The wiping mechanism 212 is arranged near the capping mechanism 211, and wipes ink droplets attached to the orifice surface of the printhead 203.

The capping mechanism 211 and wiping mechanism 212 can maintain a normal ink discharge state of the printhead 203.

<Control Configuration of Inkjet Printing Apparatus (FIG. 11)>

Figure 11:
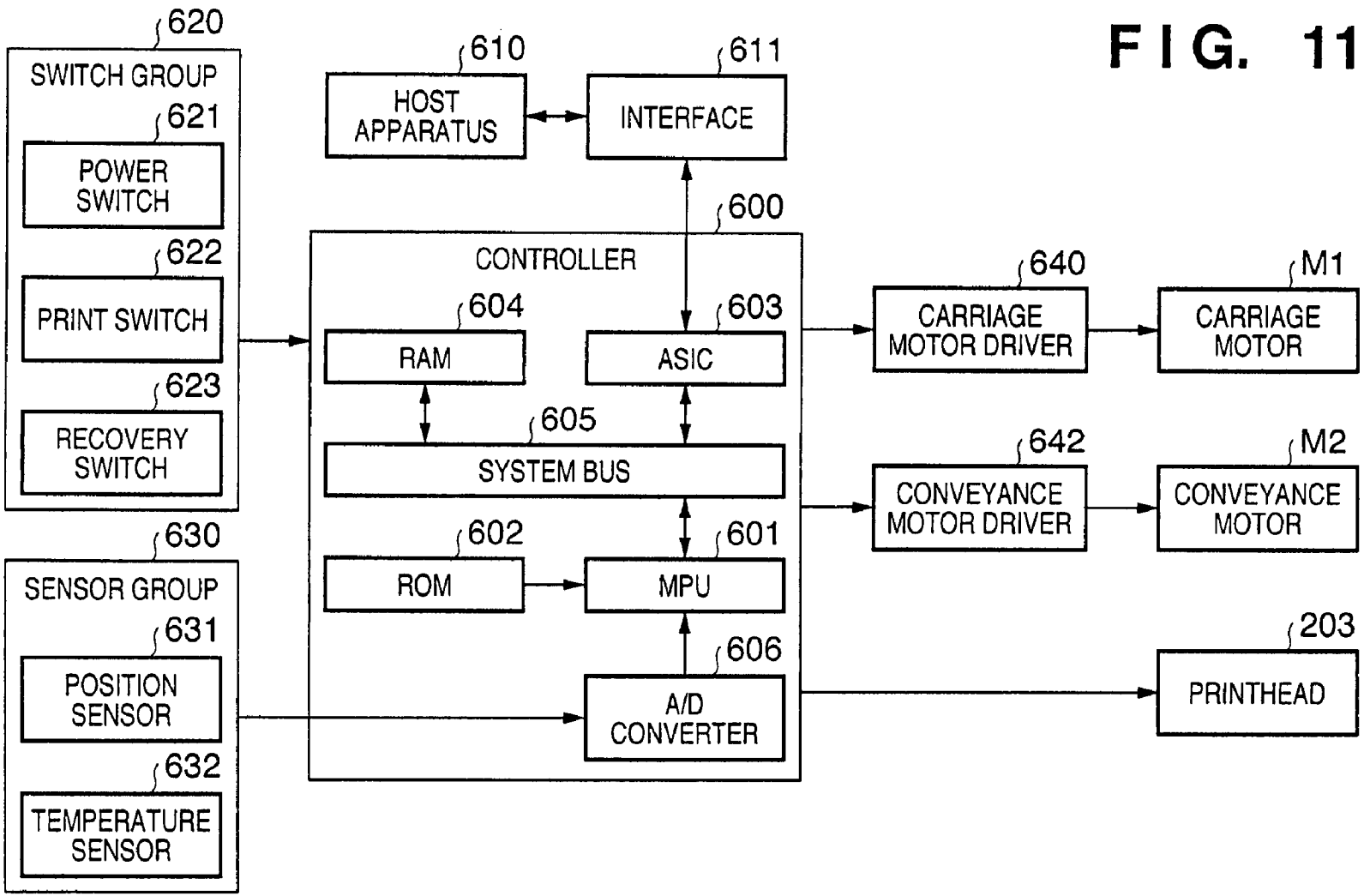
FIG. 11 is a block diagram showing the functional configuration of the inkjet printing apparatus according to the embodiment.

FIG. 11 is a block diagram showing the control configuration of the printing apparatus shown in FIG. 10.

As shown in FIG. 11, a controller 600 comprises an MPU 601, a ROM 602 which stores a program corresponding to a control sequence (to be described later), a predetermined table, and other fixed data, an ASIC (Application Specific IC) 603 which generates control signals for controlling the carriage motor M1, the conveyance motor M2, and the printhead 203, a RAM 604 having an image data rasterizing area, a work area for executing a program, and the like, a system bus 605 which connects the MPU 601, ASIC 603, and RAM 604 to each other and exchange data, and an A/D converter 606 which A/D-converts analog signals from a sensor group (to be described below) and supplies digital signals to the MPU 601.

In FIG. 11, reference numeral 610 denotes a host apparatus such as a computer (or an image reader, digital camera, or the like) serving as an image data supply source. The host apparatus 610 and printing apparatus 201 transmit/receive image data, commands, status signals, and the like via an interface (I/F) 611.

Reference numeral 620 denotes a switch group which is formed from switches for receiving instruction inputs from the operator, such as a power switch 621, a print switch 622 for designating the start of print, and a recovery switch 623 for designating the activation of a process (recovery process) of maintaining good ink discharge performance of the printhead 203. Reference numeral 630 denotes a sensor group which detects the state of the apparatus and includes a position sensor 631 such as a photocoupler for detecting a home position and a temperature sensor 632 arranged at a proper portion of the printing apparatus in order to detect the ambient temperature.

Reference numeral 640 denotes a carriage motor driver which drives the carriage motor M1 for reciprocating the carriage 202 in the direction indicated by the arrow A (FIG. 10); and numeral 642 denotes a conveyance motor driver which drives the conveyance motor M2 for conveying the printing medium P.

In printing and scanning by the printhead 203, the ASIC 603 transfers driving data (DATA) for a printing element (discharge heater) to the printhead while directly accessing the storage area of the RAM 604.

The printing apparatus further comprises a power circuit for supplying power to the above-mentioned head.

Figure 12:
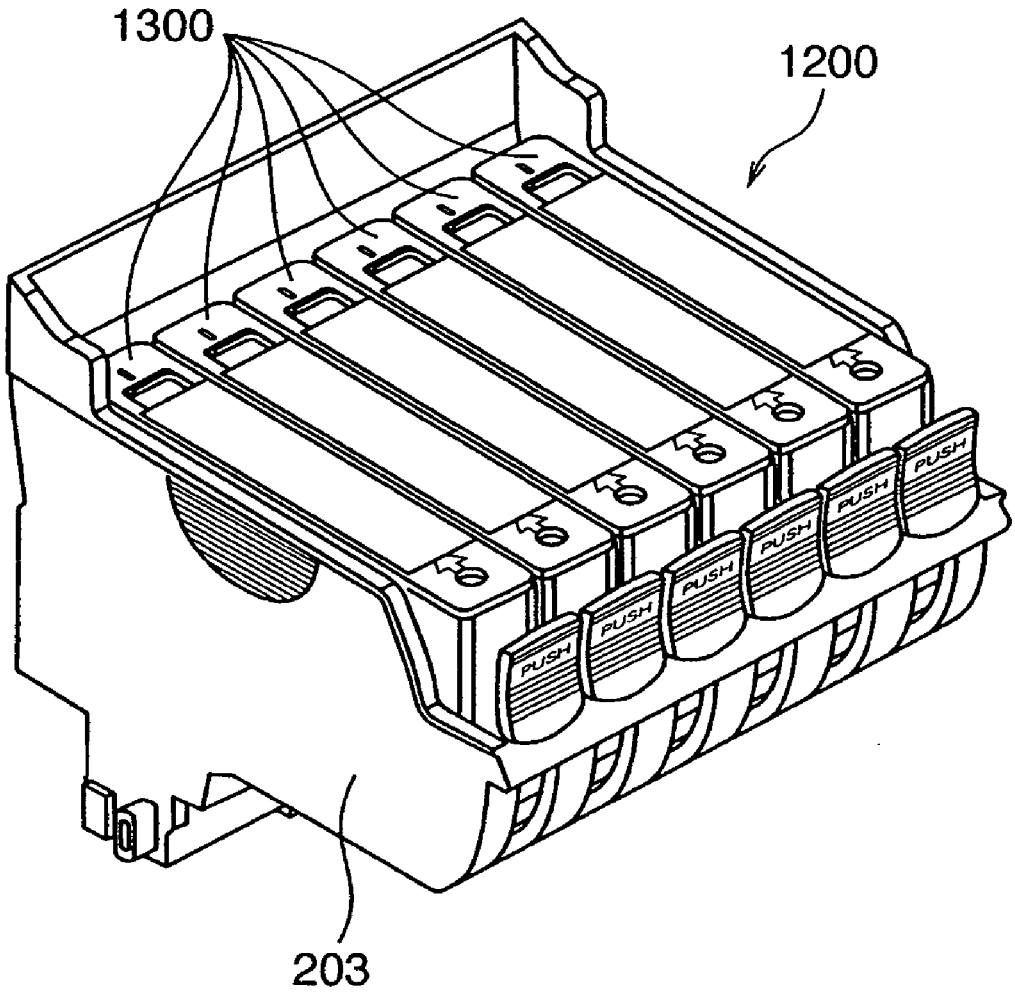
FIG. 12 depicts a schematic perspective view showing the structure of a printhead according to the embodiment.

FIG. 12 depicts a schematic perspective view showing the structure of a printhead cartridge including the printhead 203 according to the embodiment.

As shown in FIG. 12, a printhead cartridge 1200 in the embodiment comprises ink tanks 1300 which accommodates ink, and the printhead 203 which discharges ink supplied from the ink tanks 1300 from nozzles in accordance with printing data. The printhead 203 is a so-called cartridge type printhead which is detachably mounted on the carriage 202. In printing, the printhead cartridge 1200 reciprocally scans along the carriage shaft, and a color image is printed on the printing sheet P along with this scanning. In order to implement high-quality photographic color printing, the printhead cartridge 1200 is equipped with independent ink tanks for, e.g., black, light cyan (LC), light magenta (LM), cyan, magenta, and yellow, and each ink tank is freely detachable from the printhead 203.

In FIG. 12, the six color inks are used. Alternatively, printing may be done with four, black, cyan, magenta, and yellow color inks. In this case, independent ink tanks for the four colors may be detachable from the printhead 203.

Other Embodiment

As described above, the present invention can utilize a storage medium which stores software program codes for realizing the functions of the above-described embodiments in a system or apparatus, and the computer (or the CPU or MPU) of the system or apparatus reads out and executes the program codes stored in the storage medium. In this case, the program codes read out from the storage medium realize the functions of the above-described embodiments, and the storage medium which stores the program codes constitutes the present invention. The storage medium for supplying the program codes includes a floppy®disk, hard disk, optical disk, magnetooptical disk, CD-ROM, CD-R, magnetic tape, nonvolatile memory card, and ROM.

The functions of the above-described embodiments are realized when the computer executes the readout program codes. Also, the functions of the above-described embodiments are realized when an OS (Operating System) or the like running on the computer performs some or all of actual processes on the basis of the instructions of the program codes.

Furthermore, the present invention includes a case in which, after the program codes read out from the storage medium are written in the memory of a function expansion board inserted into the computer or the memory of a function expansion unit connected to the computer, the CPU of the function expansion board or function expansion unit performs some or all of actual processes on the basis of the instructions of the program codes and thereby realizes the functions of the above-described embodiments.

As has been described above, according to the embodiment, all components can be formed on a semiconductor substrate. Driving and control functions regarding constant current driving of heaters can be made very compact, and a constant current driving type heater substrate can be implemented at low cost.

By integrating functions into one substrate, the number of wiring lines to components outside the substrate decreases. The substrate is hardly influenced by external noise and rarely malfunctions.

Since the wiring length associated with control shortens, the wiring delay can decrease to increase the heater driving speed.

The present invention is not limited to the above embodiment, and various changes and modifications can be made thereto within the spirit and scope of the present invention. Therefore, to apprise the public of the scope of the present invention, the following claims are made.

The invention claimed is:

1. An inkjet printhead having a plurality of printing elements, the printhead comprising:

a plurality of switching elements comprising NMOS transistors, being arranged in correspondence with the respective printing elements, configured to control energization of the respective printing elements, wherein the plurality of printing elements and the plurality of switching elements are divided into multiple groups;

a first power supply line of a higher voltage and a second power supply line of a lower voltage, configured to supply electric power to the printing elements;

a reference voltage circuit configured to generate a reference voltage;

a current generation circuit configured to generate a reference current on the basis of the reference voltage generated by said reference voltage circuit; and a plurality of constant current sources, each of which comprises an NMOS transistor and is connected to one of the multiple groups such that each group has a constant current source, configured to supply a constant current to the printing elements in each of the multiple groups, wherein the reference current is directly supplied to the NMOS transistor of each constant current source so as to supply the constant current in accordance with the reference current, wherein each of the plurality of printing elements is directly connected to said first power supply line and each of the constant current sources is directly connected to said second power supply line, and the plurality of constant current sources supply the constant currents via said switching elements, and one of the printing elements, one of said switching elements and one of said constant current sources are connected in series between said first power supply line and said second power supply line, in an order of the printing element, said one switching element and said one constant current source from said first power supply line to said second power supply line.

2. The printhead according to claim 1, wherein each of the plurality of constant current sources forms a current mirror circuit with a current output circuit portion of said current generation circuit.

3. The printhead according to claim 1, wherein said reference voltage circuit generates as the reference voltage a voltage obtained by amplifying a band gap voltage.

4. The printhead according to claim 1, wherein each of the NMOS transistors of said constant current sources operates in a saturation region wherein a drain current hardly changes with respect to a drain voltage.

5. An inkjet head cartridge comprising:

an inkjet printhead defined in claim 1; and an ink tank configured to accommodate ink to be supplied to said printhead.

6. An inkjet printing apparatus comprising:

an inkjet printhead defined in claim 1; and driving means for driving said printhead in accordance with a printing signal.

7. A printhead substrate having a plurality of printing elements, the substrate comprising:

a plurality of switching elements comprising NMOS transistors, being arranged in correspondence with the respective printing elements, configured to control energization of the respective printing elements, wherein the plurality of printing elements and the plurality of switching elements are divided into multiple groups;

a first power supply line of a higher voltage and a second power supply line of a lower voltage, configured to supply electric power to the printing elements;

a reference voltage circuit configured to generate a reference voltage;

a current generation circuit configured to generate a reference current on the basis of the reference voltage generated by said reference voltage circuit; and a plurality of constant current sources, each of which comprises an NMOS transistor and is connected to one of the multiple groups such that each group has a constant current source, configured to supply a constant current to the printing elements in each of the multiple groups, wherein the reference current is directly supplied to the NMOS transistor of each constant current source so as to supply the constant current in accordance with the reference current, wherein each of the plurality of printing elements is directly connected to said first power supply line and each of the constant current sources is directly connected to said second power supply line, and the plurality of constant current sources supply the constant currents via said switching elements, and one of the printing elements, one of said switching elements and one of said constant current sources are connected in series between said first power supply line and said second power supply line, in an order of the one printing element, said one switching element and said one constant current source from said first power supply line to said second power supply line.

8. The substrate according to claim 7, wherein each of said plurality of constant current sources forms a current mirror circuit with a current output circuit portion of said current generation circuit.

9. The substrate according to claim 7, wherein said reference voltage circuit generates as the reference voltage a voltage obtained by amplifying a band gap voltage.

10. The substrate according to claim 7, wherein each of the NMOS transistors of said constant current sources operates in a saturation region wherein a drain current hardly changes with respect to a drain voltage.

* * * * *